US010159995B2

(12) United States Patent
Vanderzwet et al.

(10) Patent No.: US 10,159,995 B2
(45) Date of Patent: Dec. 25, 2018

(54) MULTI-PASSAGE HEATER ASSEMBLY

(75) Inventors: Dan Vanderzwet, Omemee (CA); Zygmunt Baran, Windsor (CA); Gerald Mills, Pisgah Forest, NC (US)

(73) Assignee: Doben Limited, Windsor (CA)

( * ) Notice: Subject to any disclaimer, the term of this patent is extended or adjusted under 35 U.S.C. 154(b) by 3049 days.

(21) Appl. No.: 12/515,831

(22) PCT Filed: Dec. 15, 2006

(86) PCT No.: PCT/US2006/047996

§ 371 (c)(1),
(2), (4) Date: May 21, 2009

(87) PCT Pub. No.: WO2008/073113

PCT Pub. Date: Jun. 19, 2008

(65) Prior Publication Data

US 2010/0051715 A1 Mar. 4, 2010

(51) Int. Cl.

| | |
|---|---|
| ***B05B 1/24*** | (2006.01) |
| ***B05B 7/00*** | (2006.01) |
| ***B05B 7/14*** | (2006.01) |
| ***B05B 7/16*** | (2006.01) |
| ***C23C 24/04*** | (2006.01) |

(52) U.S. Cl.

CPC ..... *B05B 7/1481* (2013.01); *B05B 7/1486* (2013.01); *B05B 7/162* (2013.01); *B05B 7/1626* (2013.01); *B05B 7/1646* (2013.01); *C23C 24/04* (2013.01)

(58) Field of Classification Search

USPC ..... 219/426, 427, 535, 544; 239/525, 526, 239/690, 695; 392/383, 384, 385

See application file for complete search history.

(56) References Cited

U.S. PATENT DOCUMENTS 2,609,477 A * 9/1952 Borda ..... B29C 73/305 392/383
2,750,487 A * 6/1956 Hynes ..... 392/489
3,904,851 A * 9/1975 Gustafson ..... F24H 3/0405 219/542
4,065,057 A * 12/1977 Durmann ..... B05B 7/1626 239/133
4,090,643 A * 5/1978 Wilkinson et al. ..... 222/146.5
4,281,238 A * 7/1981 Noma et al. ..... 219/535
4,704,516 A * 11/1987 Tsutsumi ..... 219/421

(Continued)

OTHER PUBLICATIONS

International Preliminary Report on Patentability for International application No. PCT/US06/47996 dated May 3, 2011.

(Continued)

*Primary Examiner* — Joseph M Pelham

(74) *Attorney, Agent, or Firm* — Carlson, Gaskey & Olds, P.C.

(57) ABSTRACT

A gas dynamic spray unit is provided that includes gun housing halves secured about a heater assembly. The heater assembly includes a one-piece, multi-passage ceramic heater core. The heater assembly is retained within the gun housing using locating features provided on the heater assembly and the gun housing. The heater assembly includes a heater housing at least partially surrounding the heater core. A biasing member biases the ceramic heater core toward a tapered outlet, which is provided by a deflecting cone surrounded by an insulating cone.

18 Claims, 2 Drawing Sheets

(56) References Cited

U.S. PATENT DOCUMENTS

| | | | | |
|---|---|---|---|---|
| 4,858,336 | A * | 8/1989 | Varma | 34/90 |
| 5,117,482 | A * | 5/1992 | Hauber | H05B 3/148 239/135 |
| 5,909,535 | A * | 6/1999 | Curwick | B29C 65/10 219/230 |
| 6,096,249 | A * | 8/2000 | Yamaguchi | 264/40.3 |
| 6,291,802 | B1 * | 9/2001 | Ford | 219/427 |
| 6,726,884 | B1 * | 4/2004 | Dillon et al. | 422/179 |
| 6,730,175 | B2 * | 5/2004 | Yudovsky | C23C 16/45521 118/500 |
| 6,811,100 | B2 * | 11/2004 | Bardinet | A47L 1/08 239/197 |
| 7,047,660 | B2 * | 5/2006 | Leventhal | 34/97 |
| 7,883,034 | B2 * | 2/2011 | Matsui et al. | 239/695 |
| 2004/0222209 | A1 * | 11/2004 | Godwin | B29C 45/1603 219/426 |
| 2007/0114219 | A1 * | 5/2007 | Rizzuto, Jr. | 219/222 |
| 2007/0160769 | A1 * | 7/2007 | Maev et al. | 427/446 |
| 2007/0294909 | A1 * | 12/2007 | Abdi et al. | 34/97 |
| 2010/0051718 | A1 * | 3/2010 | Vanderzwet | C23C 24/04 239/135 |
| 2013/0177712 | A1 * | 7/2013 | Binder | B05B 7/1613 427/456 |

OTHER PUBLICATIONS

International Search Report for PCT Application No. PCT/US06/47996, dated Oct. 19, 2007.

* cited by examiner

MULTI-PASSAGE HEATER ASSEMBLY

BACKGROUND

This application relates to a multi-passage heater assembly. More particularly, the application relates to a multi-passage heater assembly suitable for use with, for example, a gas dynamic cold spray gun.

Portable gas dynamic spray guns are being developed to widen their application and reduce the cost of using cold spray technology. Low-pressure cold spray systems are used for spraying powdered material at supersonic velocities. The low-pressure carrier gas is supplied to the spray gun at typically less than 10 bar (150 psi). The carrier gas passes through a heater assembly, which heats the carrier gas to reduce its density. The heated gas then flows through a venturi throat and is accelerated. Powdered material is then introduced into the gas jet and is expelled at a supersonic velocity towards a substrate. The powdered material typically includes a single constituent abrasive, metal, metal alloy or a blend of such materials. The powdered material can be used to prepare (clean or abrade) the surface or deposit a coating onto the substrate.

It is desirable to commercialize portable gas dynamic spray units, which has not been done very successfully. Prior art cold spray guns are rather heavy and can pose safety issues to the user due to the high operating temperature of the heater assembly, which may be between 400-650° C. during use. Moreover, packaging the cold spray gun components in a portable size that is also durable can be difficult. For example, the heater assembly in some cold spray guns is susceptible to breakage and electrical shorts due to rough handling. Other heater assemblies, which are rather heavy and not adapted to cold spray technology, generate heat in such a way that would expose the user to very high temperatures.

What is needed is a gas dynamic spray unit more suitable for commercialization.

SUMMARY

A gas dynamic spray unit is provided that includes gun housing halves, which may be a polymer, secured about a heater assembly. The heater assembly includes a one-piece, multi-passage ceramic heater core. The heater assembly is retained within the gun housing using locating features provided on the heater assembly and the gun housing.

The heater assembly includes a heater housing at least partially surrounding the heater core. A biasing member biases the ceramic heater core toward a tapered outlet, which is provided by a deflecting cone surrounded by an insulating cone.

An outlet fitting is secured to the heater assembly and supports a nozzle having a venturi that accelerates a carrier gas. The carrier gas is supplied to the nozzle by a passageway. A powder feed passage communicates with the nozzle to provide powdered material to the accelerated carrier gas, which is expelled from a tube. The passageway includes an aperture for leaking carrier gas inside the gun housing to pressurize the gun housing and prevent powdered material from infiltrating the gun housing. A shroud is secured to the gun housing about the tube to prevent damage to the tube and protect the user from contacting the hot nozzle and tube.

These and other features can be best understood from the following specification and drawings, the following of which is a brief description.

DETAILED DESCRIPTION OF THE PREFERRED EMBODIMENT

Figure 1:
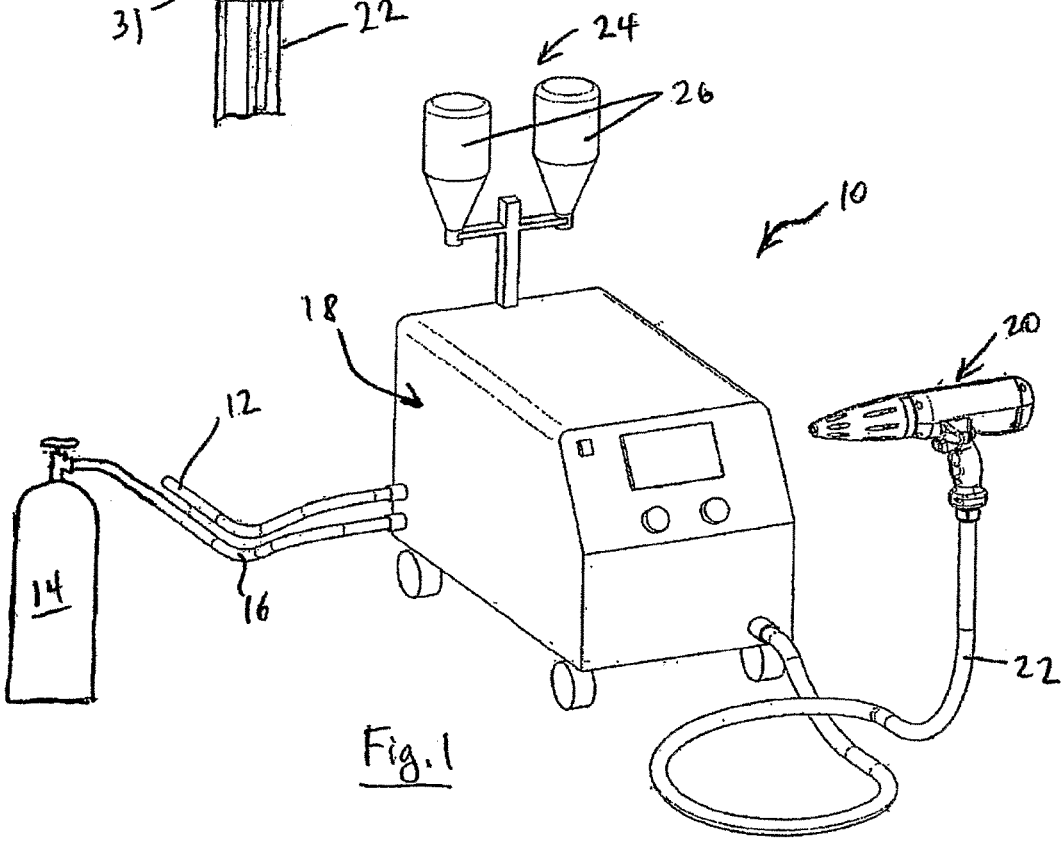
FIG. 1 is a schematic perspective view of an example cold spray unit.

A cold spray unit 10 is shown in FIG. 1. The unit 10 includes a control unit 18 connected to a power supply and a gas source 14 via a gas supply 16. A spray gun 20 is connected to the control unit 18 by a service cable 22. The control unit 18 controls and monitors the various inputs and outputs of the unit 10 to obtain desired deposition of powder material onto the substrate. For example, the control unit 18 monitors and regulates the process parameters such as gas pressure, gas flow rate, heater temperature, and powder system sequencing. The control unit 18 allows the operator to monitor and adjust settings and provide data on maintenance status, process efficiency, and communicate this data to a higher order control.

A powder feeder 24 having one or more powder containers 26 supplies powder material to the spray gun 20 for deposition onto a substrate. The powder feeder 24 supplies a regulated amount of powder to the spray gun 20. Example powdered materials include ceramic, metal, metal alloy, or other hard materials. The powdered material is supplied to the spray gun 20 at the times and rates commanded by the control unit 18. It is desirable for the powder containers 26 to be designed to withstand some pressure, which may be caused by an obstruction downstream during the spraying process.

Figure 2:
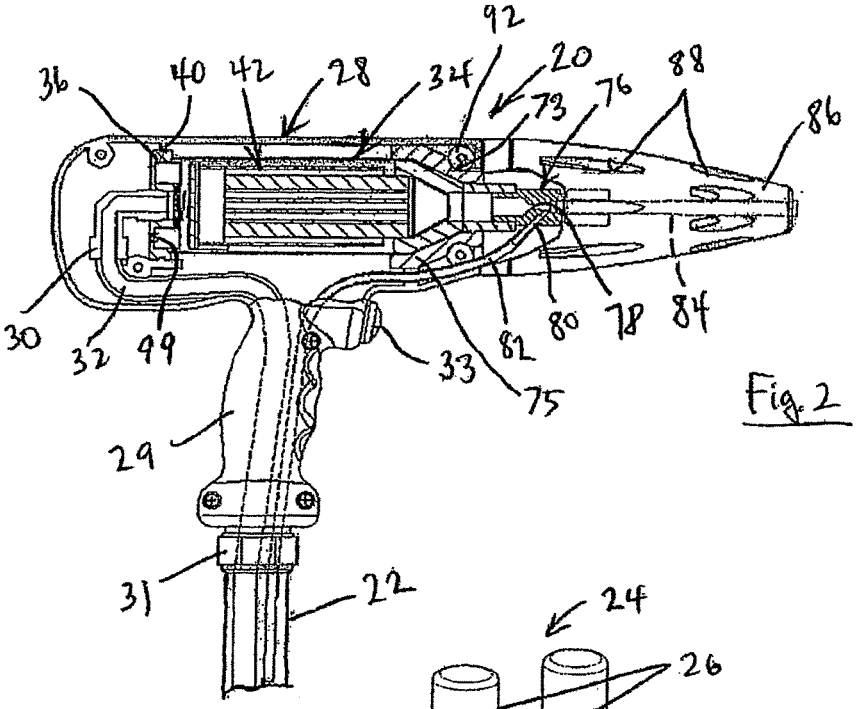
FIG. 2 is a partially broken cross-sectional view of an example spray gun, which is illustrated in FIG. 1.

The spray gun 20 is shown in more detail in FIG. 2. The spray gun 20 includes a gun housing 28, which is two plastic halves secured to one another in one example. In one example, the gun housing 28 is constructed from an impact and heat resistant glass-reinforced polymer. Providing two halves simplifies assembly.

The service cable 22 is secured to a handle 29 of the spray gun 20 by a strain relief fitting 31. The service cable 22 includes adequate protection for the internal connections and passageways that it houses. A trigger 33 is provided on a handle 29 and signals the control unit 18 to turn on or off. The control unit 18 directs the flow of carrier gas and, with appropriate feedback signals, allows feeding of powders and performs regulation of the powder-laden gas jet. An indicator on the gun housing 28 (not shown) provides confirmation to the operator of the selected operating mode.

A heater assembly 34 is arranged within the gun housing 28 to rapidly heat the carrier gas and reduce its density. The heater assembly 34 includes an inlet fitting 36 that receives a gas inlet 30 secured to a gas line 32. The gas line 32 provides a carrier gas to the spray gun 20. Features provided by the gun housing 28 are used to locate the heater assembly without requiring additional fasteners. In one example, the inlet fitting 36 includes an annular groove 38 that receives a protrusion 40 provided by the gun housing 28 to locate the rear portion of the heater assembly 34 within the spray gun 20.

In one example, the inlet fitting 36 includes an aperture 99 that accommodates a heating wire for a heater core 42 (FIG. 3). The aperture 99 is in communication with a passageway the supplies the carrier gas to the heater core 42. The aperture 99 is designed to create a controlled leak within the gun housing 28 that pressurizes the spray gun 20, which prevents infiltration of the powdered material into the gun housing 28. The leaked carrier gas escaped between the gun housing joint halves as well as other areas of the spray gun 20 (such as the front, which is hottest).

Figure 3A:
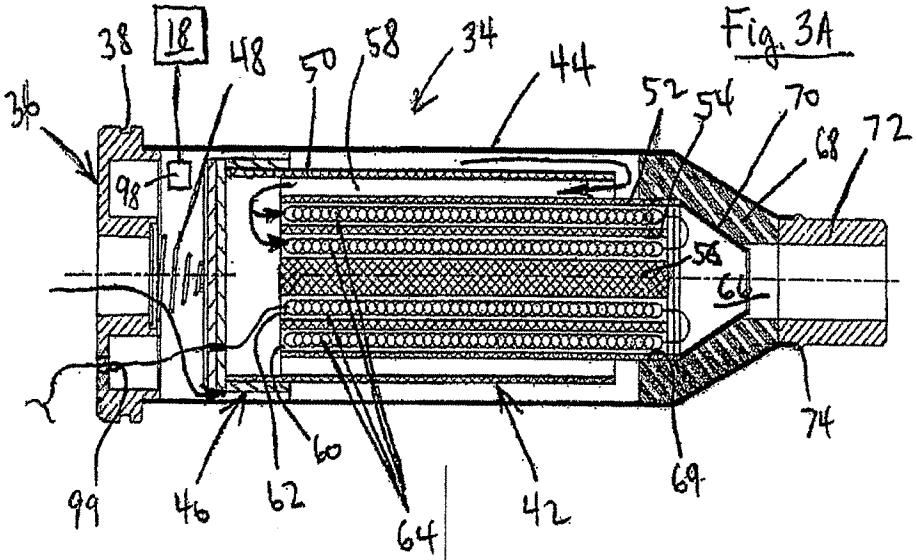
FIG. 3*a* is a cross-sectional view of a heater assembly taken along line 3*a*-3*a* in FIG. 3*b*.

Referring to FIG. 3*a,* the heater assembly 34 provides the heater core 42 that receives the carrier gas from the gas line 32 and heats it to a desired temperature, typically between 400-650° C. In the example, the heater core 42 is a one-piece ceramic structure that is relatively simple to manufacture. The ceramic heater core 42 better ensures that the gun housing 28 does not become too hot for an operator to handle. The heater core 42 is a multi-passage arrangement. In the example, the heater core 42 includes an outer wall 50 concentrically arranged about first and second spaced apart walls 52, 54. An inner wall 56 is arranged within the second wall 54. The walls 50, 52, 54, 56 respectively provide an outer passage 58 and first and second passages 60, 62.

Figure 3B:
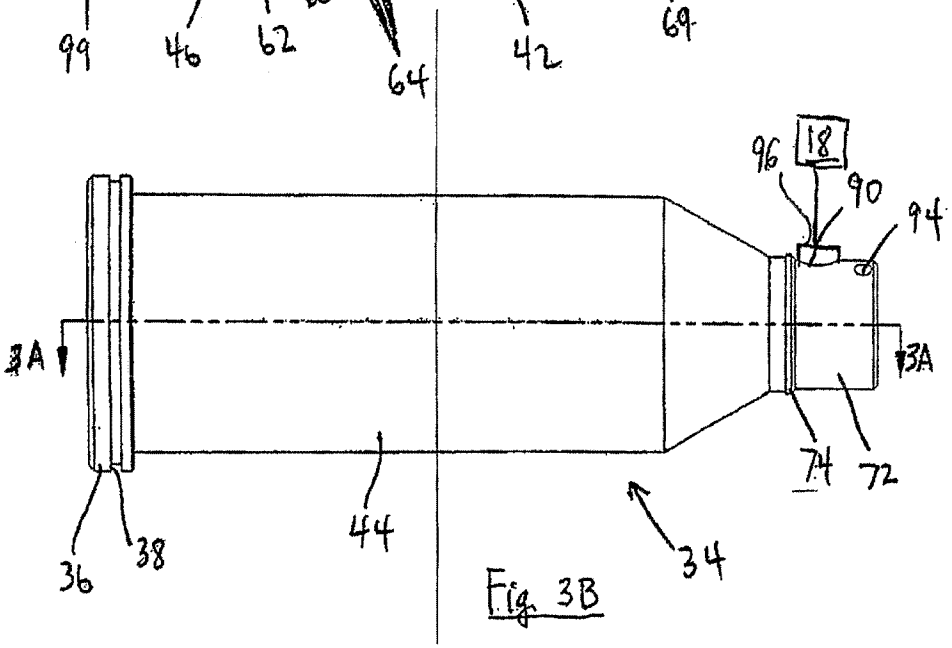
FIG. 3*b* is a side elevational view of the heater assembly shown in FIG. 3*a*.
Figure 3C:
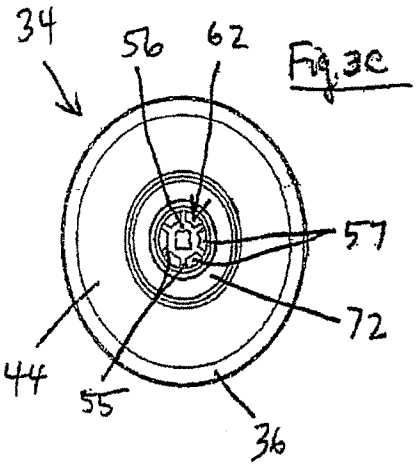
FIG. 3*c* is an end view of the heater assembly shown in FIGS. 3*a* and 3*b*.

In one example, support legs 55 extend radially between the inner wall and first wall 56, 52, as shown in FIG. 3*c*. Similar support legs (not shown) extend between the first and second wall 52, 54 and second and outer wall 54, 50. In this manner, a one-piece ceramic structure can be provided. In one example, the support legs 55 are continuous the length of the flow passages which are divided by the support legs 55 into circumferentially arranged flow channels 57, best shown in FIG. 3C.

A heater housing 44, which is stainless steel in one example, surrounds the heater core 42. In one example, the heater housing is spin formed to reduce its weight and thermal mass. An end of the heater core 42 is received in a retaining cup 46, which is biased forward by a biasing member 48 (for example, a spring) arranged between the retaining cup 46 and the inlet fitting 36. The biasing member 48 accommodates thermal expansion of the heater assembly components without overstressing any of its fragile components, such as the ceramic heater core 42. Moreover, the biasing spring 48 reduces issues relating to tolerance stack-ups within the heater assembly 34. An end of the heating core 42 opposite the retaining cup 46 extends axially outward relative to the outer wall 50 and is received in an aperture 69 of an insulating cone 68. The insulating cone 68 keeps the temperatures at the front of the gun housing 28 to a minimum and reduces any shock transmitted to the ceramic heater core 42.

Heating elements 64 are arranged within the first and second passages 60, 62 in the example shown. Additional and/or fewer heating elements can be used depending upon the amount of heat desired and the packaging constraints. In operation, the carrier gas flows into the heater housing 44 through the inlet fitting 36 via the gas inlet 30 (FIG. 2). The carrier gas flows along the inner surface of the heater housing 44 radially outward of the heater core 42. This first pass of carrier gas also acts to insulate the heated gases at the interior of the heater core 42 and minimize heat transfer to the gun housing 28. The carrier gas flows through the outer passage 58 and simultaneously through the first and second passages 60, 62 where the carrier gas is rapidly heated by heating elements 64. Additional or fewer passes can be provided to obtain desired heating of the carrier gas within the packaging constraints.

The heated carrier gas converges to an outlet 66 where the gas is focused by a deflecting cone 70. In one example, the deflecting cone 70 is constructed from a stainless steel material. The deflecting cone 70 prevents the erosion of the ceramic insulating cone 68 over time to reduce the service requirements for the heater assembly 34 and extend its life An outlet fitting 72 is received by an end of the heater housing 44 and secured thereto by a weld bead 74. The outlet fitting 72 includes an indentation 90 that receives a temperature sensor 96 for temperature feedback to the control unit 18. The temperature sensor 96 is provided near the outlet 66 for monitoring the temperature of the heater core 42. The temperature sensor 96 is in communication with the control unit 18 so that the desired carrier gas temperature can be maintained. In one example, the unit 10 can be shut down if no heating of the carrier gas is detected. In another example, the unit 10 can be shut down if undesirably high temperatures are reached.

Referring to FIGS. 2 and 3*b,* bosses 92 on the gun housing 28, which provide the locating features 73 for a supplemental insulating cone 75. The front portion of the heater assembly 34 is closely fitted with supplemental insulating cone 75 and is retained in this position by the biasing member 48. This way the heater assembly 34 is maintained in proper orientation within the gun housing 28 without the use of additional fasteners in the example.

The outlet fitting 72 receives a nozzle 76 that provides a venturi for accelerating the carrier gas. The outlet fitting 72 includes a hole 94 for receiving a set screw (not shown) that secures the nozzle 76 to the outlet fitting 72. The nozzle 76 includes a throat 78. In one example, a converging section is provided upstream from the throat 78, and a diverging section is provided downstream from the throat. In one example, a powder feed passage 80 is provided in the nozzle 76 downstream from the throat 78 for introducing powder material provided through a powder feed line 82. A tube 84 is received in an end of the nozzle 76, which deposits the supersonic powder material on the substrate.

A shroud 86 is secured to the gun housing 28 and at least partially surrounds the tube 84. The shroud 86 prevents the tube 84 from becoming bent or damaged, which would change the powder material deposition characteristics. Moreover, the shroud 86 protects the user from unwanted contact with the tube 84, which could burn the user. Openings 88 are provided in the shroud 86 to provide cooling to the nozzle 76 and tube 84.

A pressure sensor 98 (FIG. 3*a*) is in fluid communication with the spray gun 20 to monitor the pressure of the carrier gas. In one example, the pressure sensor 98 is used to ensure that sufficient carrier gas pressure is available to cause adequate flow through the heater core 42 to prevent over heating in the event insufficient gas is present. Pressure sensor 98 is located in the space between the inlet fitting 36 and the retaining cup 46. In this location the sensitive pressure sensor circuitry is maintained at a sufficiently cool temperature so as to ensure a long service life.

Although example embodiments have been disclosed, a worker of ordinary skill in this art would recognize that certain modifications would come within the scope of the claims. For that reason, the following claims should be studied to determine their true scope and content.

The invention claimed is:

1. A heater assembly comprising:

a non-metallic heater core providing multiple concentric passages leading to a common outlet that provides an exit opening to the heater assembly, at least two of the concentric passages including individual heating elements extending from a first end to a second end, the heater core including radially spaced apart walls providing the concentric passages, wherein the heater assembly is configured such that a fluid flows from the first end to the second end in a flow direction, and the fluid flows from the second end to the exit opening in a same direction as the flow direction.

2. The heater assembly according to claim 1, wherein the walls are interconnected by radially extending support legs separating the passages into circumferential channels.

3. The heater assembly according to claim 1, wherein the heater core is a one-piece, unitary ceramic structure.

4. The heater assembly according to claim 1, comprising an insulating cone including an aperture receiving the heater core, the insulating cone providing the common outlet.

5. The heater assembly according to claim 4, comprising a metallic heater housing at least partially surrounding the heater core and the insulating cone.

6. The heater assembly according to claim 5, wherein the insulating cone is non-metallic.

7. The heater assembly according to claim 4, comprising a metallic deflecting cone arranged interiorly of the insulating cone at the common outlet to provide adjoining layers with the metallic deflecting cone and the insulating cone.

8. The heater assembly according to claim 3, comprising a heater housing at least partially surrounding the heater core, an inlet fitting arranged at one end of the heater housing, a biasing member arranged between the inlet fitting and the heater core urging the heater core away from the inlet fitting.

9. The heater assembly according to claim 8, wherein the inlet fitting provides a common inlet to the non-metallic heater core.

10. The heater assembly according to claim 1, wherein at least one of the concentric passages is arranged radially outward of the heating element for insulating the heating element.

11. The heater assembly according to claim 1, comprising a metallic heater housing at least partially surrounding the heater core and providing an outer passage between the heater housing and the heater core, the outer passage configured to receive an inlet flow of a carrier gas, with the carrier gas flowing radially inward from the outer passage into the heater core, the outer passage insulating the heater core.

12. The heater assembly according to claim 11, wherein at least one of the concentric passages is arranged radially between the outer passage and the at least two of the passages having the heating element, the at least one of the concentric passages configured to receive the carrier gas from the outer passage and provide the carrier gas to the at least two of the passages including the heating element, the at least one of the concentric passages further insulating the at least two of the passages including the heating element.

13. The heater assembly according to claim 1, wherein the concentric passages are annular.

14. A heater assembly comprising:

a heater core providing a passage having a heating element;

a heater housing at least partially surrounding the heater core;

a biasing member at one end of the heater core, urging the heater core to an end of the heater housing; and a non-metallic insulating cone at the opposite end of the heater core and supported by the heater housing, the biasing member urging the heater core into engagement with the insulating cone.

15. The heater assembly according to claim 14, wherein the biasing member is a coil spring.

16. A heater assembly comprising:

a ceramic heater core providing parallel concentrically nested passages having individual heating elements;

a non-metallic insulating cone receiving an end of the heater core, the cone in fluid communication with the concentrically nested passages so as to guide the fluid from the passages to a common outlet.

17. The heater assembly according to claim 16, wherein the insulating cone is ceramic.

18. The heater assembly according to claim 17, comprising a deflecting cone arranged interiorly of the insulating cone and providing the outlet.

* * * * *